US006852047B2

(12) United States Patent
Tucker, Sr.

(10) Patent No.: US 6,852,047 B2
(45) Date of Patent: Feb. 8, 2005

(54) POCKET-DAMPENING LACROSSE HEAD

(75) Inventor: Richard B. C. Tucker, Sr., Ruxton, MD (US)

(73) Assignee: STX, LLC, Baltimore, MD (US)

( * ) Notice: Subject to any disclaimer, the term of this patent is extended or adjusted under 35 U.S.C. 154(b) by 30 days.

(21) Appl. No.: 10/282,067

(22) Filed: Oct. 29, 2002

(65) Prior Publication Data

US 2004/0082412 A1 Apr. 29, 2004

(51) Int. Cl.[7] ..... A63B 59/02; A63B 65/12
(52) U.S. Cl. ..... 473/513
(58) Field of Search ..... 473/513, 512, 473/514, 505, 528; D21/724

(56) References Cited

U.S. PATENT DOCUMENTS 3,507,495 A * 4/1970 Fracalossi et al. ..... 473/513
4,034,984 A * 7/1977 Crawford et al. ..... 473/513
4,097,046 A 6/1978 Friant
4,138,111 A 2/1979 Rule
4,358,117 A 11/1982 Deutsch
5,082,290 A 1/1992 Tucker et al.
5,178,397 A * 1/1993 Brine, Jr. ..... 473/513
5,566,947 A * 10/1996 Tucker et al. ..... 473/513
5,674,140 A 10/1997 Tucker et al.
5,957,791 A * 9/1999 Nichols et al. ..... 473/513

* cited by examiner

*Primary Examiner*—Gregory Vidovich
*Assistant Examiner*—M. Chambers
(74) *Attorney, Agent, or Firm*—Shaw Pittman LLP

(57) ABSTRACT

A method and apparatus for dampening the rebound of a lacrosse head pocket. In one embodiment, the apparatus includes a frame having a thread hole and an aperture proximate to the thread hole. The aperture creates a moveable structure of the frame. The moveable structure encompasses at least a portion of the thread hole. The moveable structure is adapted to flex relative to the frame.

35 Claims, 20 Drawing Sheets

POCKET-DAMPENING LACROSSE HEAD

BACKGROUND

1. Field of the Invention

The present invention relates generally to lacrosse sticks, and more particularly, to an apparatus and method for dampening the rebound of a lacrosse head pocket after the pocket has been pulled taut by, for example, a caught, thrown, or cradled lacrosse ball.

2. Background of the Invention

Since they were first introduced around 1970, double-wall, synthetic lacrosse heads have revolutionized the game of lacrosse. In comparison to the early single-wall wooden lacrosse heads, synthetic heads offer vastly improved feel, balance, lightness, maneuverability, and flexibility. The synthetic heads are also less expensive to manufacture and can be produced with a more consistent level of quality. And, perhaps most importantly, the synthetic heads offer superior durability, withstanding the harsh impacts and bending encountered during play, such as during face-offs and defensive checking.

FIG. 1 illustrates a conventional molded-head lacrosse stick. As shown, lacrosse stick 100 includes a handle 102 shown in dotted lines, and a double-wall synthetic head 104. Head 104 includes a generally V-shaped frame having a juncture 106, sidewalls 108 and 110, a transverse wall (or "scoop") 112 joining the sidewalls at the end opposed to juncture 106, and a stop member 114 joining sidewalls 108 and 110 at the end nearest juncture 106. As shown, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs (such as that of U.S. Pat. No. 4,034,984 to Crawford et al.), upper thong holes 116 are located on tabs of the scoop 112. On other designs, as in FIG. 1, upper thong holes 116 are located within scoop 112. FIG. 1 shows four pairs (116, 118) of thong holes that accept four thongs.

To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string hole 124 and a string laced through string hole 122. The typical features of a lacrosse stick are all shown generally in Tucker et al., U.S. Pat. No. 3,507,495; Crawford et al., U.S. Pat. No. 4,034,984; and Tucker et al., U.S. Pat. No. 5,566,947 which are all incorporated by reference herein.

In addition to traditionally strung heads, some heads use mesh pockets or a combination of traditional and mesh stringing. In any case, the mesh or stringing is conventionally attached to the head through holes in the scoop, sidewalls, and stop members, or through holes in rigid tabs attached to the scoop, sidewalls, and stop members. As used herein, thread holes or thread openings refer to the holes that receive the various forms of pocket stringing, such as the holes in the scoop, sidewalls, and stop members, or the holes in tabs attached to the scoop, sidewalls, and stop members. Also, as used herein, a pocket thread refers to any member, such as a thong, string, or mesh, that forms the pocket or attaches the pocket to the lacrosse head.

The traditional double-wall synthetic head is an injection-molded, monolithic structure. Examples of suitable synthetic materials well known in the art include nylon, urethane, and polycarbonate. These materials are generally regarded as superior to wood, offering players improved handling and durability. For example, a lacrosse head constructed of DuPont™ ZYTEL ST-801 nylon resin is able to withstand the bending and harsh impacts inherent to competition far better than a traditional wooden stick. As another example, polycarbonate, though having flexibility similar to wood, is more structurally durable than wood and much lighter, and therefore easier to handle.

Although the synthetic materials impart many performance advantages over traditional wooden heads, the synthetic, monolithic double-wall head fails to outperform the wooden heads in one critical aspect: pocket "give." Specifically, the rigidity required for durability is at odds with the desire for "give" in the pocket when receiving a heavy, hard rubber lacrosse ball. Because the synthetic heads use substantially rigid materials to provide the structural integrity and durability of the head frame, the thong holes in the substantially rigid head provide little deflection against which the pocket strings can pull. In other words, the thong holes in a synthetic head do not deaden the pull of the pocket webbing, as occurs, for example, when a lacrosse ball hits the pocket. This lack of impact absorption is noticeable in comparison to a wooden single-wall head, which fixes the pocket webbing to a pliable gut wall. Thus, there remains a need for a synthetic lacrosse head design that provides the pocket "give" of a wooden head, while maintaining the light weight, durability, and structural integrity of traditional synthetic lacrosse heads.

Notably, this pocket "give" is most critical in the women's game, in which shallow pocket depth rules necessitate tightly strung pockets. Given that the combined height of the sidewall and pocket cannot exceed the size of the game ball (2½ inches), the netting suspended from the women's lacrosse head forms little, if any, pocket and remains substantially in the same plane as the head itself. As a result of the necessary tension, when the lacrosse ball hits the pocket, the impact often causes a trampoline effect that makes the ball hard to catch and control. Indeed, for all but the most skilled players, a lacrosse ball can easily bounce out of the rebounding pocket. In essence, the pocket, strung on a rigid unforgiving frame, acts like the strings of a tennis racquet and rebounds the ball out of the pocket. Although this trampoline effect is more pronounced in the tightly strung women's lacrosse heads, the desire to absorb the impact of an incoming ball is equally applicable to men's lacrosse heads.

SUMMARY OF THE INVENTION

The present invention is a method and apparatus for dampening the rebound of a lacrosse head pocket after the pocket has been pulled taut. Unlike the substantially rigid lacrosse head frames of the prior art, which attach pocket threads to unforgiving, rigid structures, the present invention provides a flexible energy-absorbing moveable structure to which a pocket is strung. The moveable structure is part of an otherwise rigid lacrosse head frame. The flexibility of the moveable structure produces a "give" that minimizes the rebound of a pocket after being impacted by a ball. This pocket dampening limits the movement of the ball and makes the ball easier to control and to retain in the pocket.

Depending on where the moveable structure is located on the lacrosse head frame, the moveable structure provides the pocket "give" in response to, for example, the pull force on the pocket created by a regulation lacrosse ball impacting the pocket during a catch or swinging in the pocket during cradling.

In one embodiment, the present invention includes a frame having a thread hole and an aperture proximate to the thread hole. The aperture creates a moveable structure of the frame. The moveable structure encompasses at least a portion of the thread hole. The moveable structure is adapted to flex relative to the frame when pulled by a pocket thread attached to the thread hole.

DETAILED DESCRIPTION OF THE INVENTION

Figure 1:
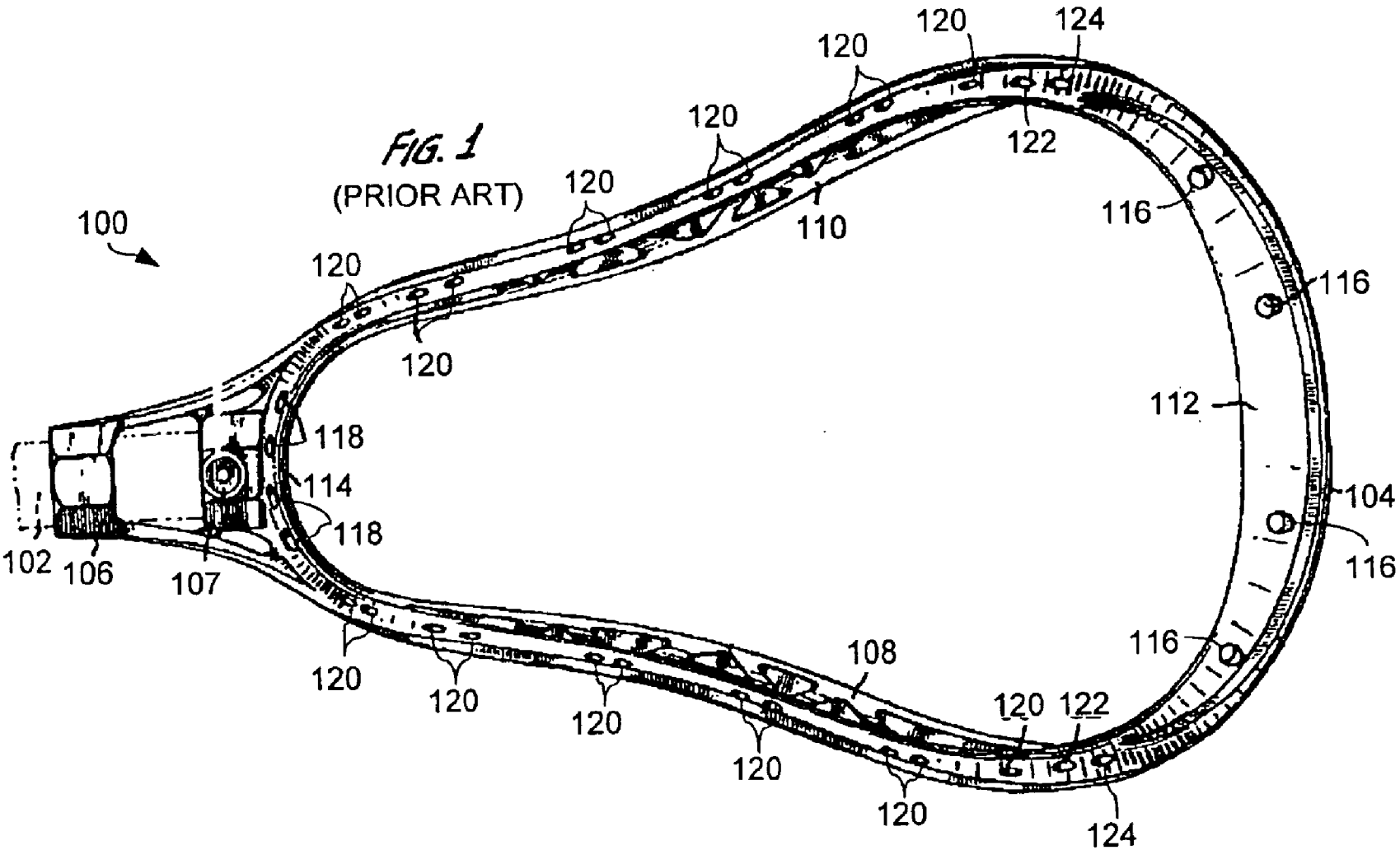
FIG. 1 (PRIOR ART)
FIG. 1 is a schematic diagram of a conventional molded-head lacrosse stick.
Figure 2A:
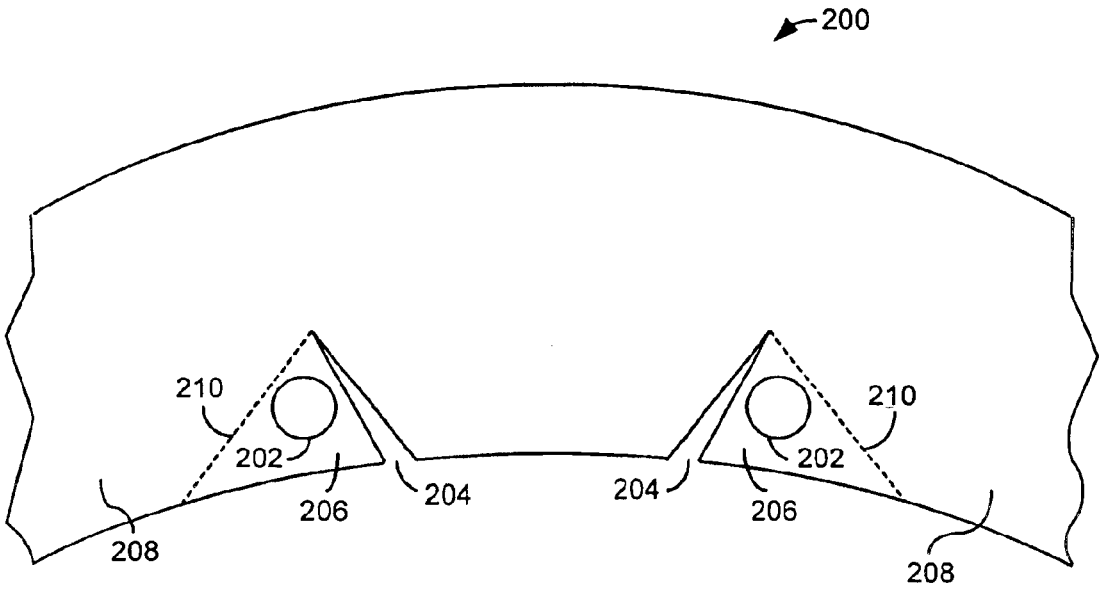
FIG. 2A is a schematic diagram of an apparatus for deadening the pull of a pocket against a lacrosse head, according to an embodiment of the present invention.

The present invention is a method and apparatus for absorbing the energy of a lacrosse ball moving into and within a lacrosse head pocket. FIG. 2A shows an embodiment of the invention, which includes a lacrosse head frame 200 having a thread hole 202 and an aperture 204. Thread hole 202 is located anywhere on lacrosse head frame 200 (e.g., ball stop, sidewalls, or scoop) and receives a string or thong of a pocket that is attached to frame 200. Although shown as a circle, thread hole 202 could, of course, be of any shape (e.g., an oval or slit) suitable for receiving a pocket thread. Aperture 204 is proximate to thread hole 202, such that frame 200 is separated into a moveable structure 206 and a rigid frame structure 208. Moveable structure 206 encompasses at least a portion of thread hole 202 and moves relative to rigid frame structure 208. In this example, the boundary between moveable structure 206 and rigid frame structure 208 is flex line 210, due to the position of aperture 204.

Although shown as a triangular notch, aperture 204 could be any opening in frame 200 that, by being proximate to thread hole 202, creates a moveable structure that moves relative to the remaining portion of lacrosse head frame 200. Flex line 210 is representative of a boundary between the moveable structure and the rigid frame structure, and could, of course, vary depending on factors such as the material from which frame 200 is made, the width and thickness of frame 200, the shape and position of aperture 204, and the relative positions of aperture 204 and thread hole 202. Flex line 210 could also be an actual structural element of frame 200, at which frame 200 is structurally weakened to promote flexing, e.g., by scoring or perforating frame 200 at flex line 210. In addition, as one of ordinary skill in the art would appreciate, the moveable structure and the rigid frame structure may not be separated by a well-defined boundary, such as a flex line. For example, the transition between moveable structure and the rigid frame structure could be gradual as provided by a steadily decreasing material thickness. Thus, it should be understood that this specification uses the term "flex line" for illustration purposes only, and that the present invention is not limited to having a defined flex line between the moveable structure and the rigid frame structure.

Figure 2B:
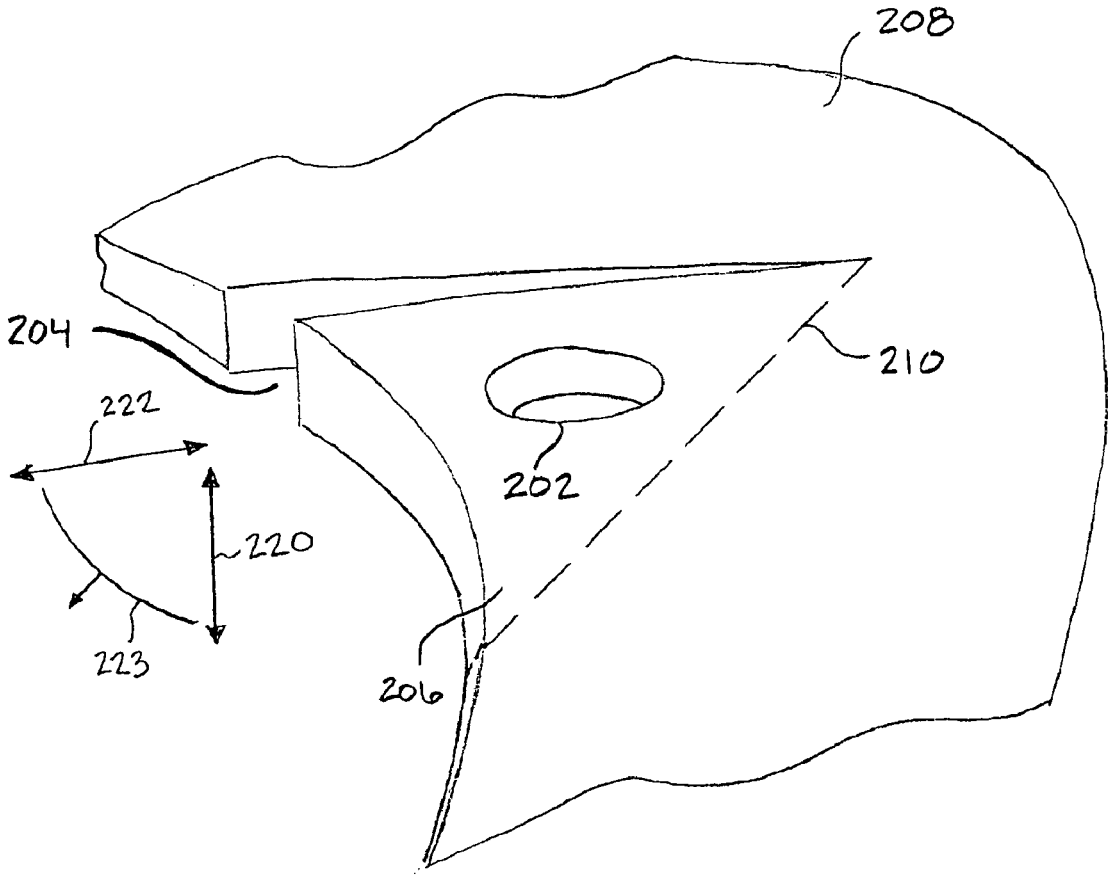
FIG. 2B is a schematic diagram of a side view of the apparatus shown in FIG. 2A.

FIG. 2B illustrates a side view of the frame 200, thread hole 202, and aperture 204 shown in FIG. 2A. This side view demonstrates the directions in which moveable structure 206 can flex. Specifically, moveable structure 206 flexes in the general direction of arrow 220, which roughly corresponds to a direction perpendicular to the face of thread hole 202. Moveable structure 206 achieves the movement in the direction of arrow 220 by bending or twisting along flex line 210. Depending on the configuration (e.g., shape and placement) of aperture 204, moveable structure 206 may also move in the general direction of arrow 222 (which roughly corresponds to a direction parallel to the face of thread hole 202) or in any of directions 223 between arrow 220 and 222. Examples of aperture configurations that achieve these different directions of "give" are described below in reference to FIGS. 4–18D. In each case, the configuration of aperture 204 enables moveable structure 206 to flex in a desired direction by, for example, bending, compressing, or twisting.

Figure 2C:
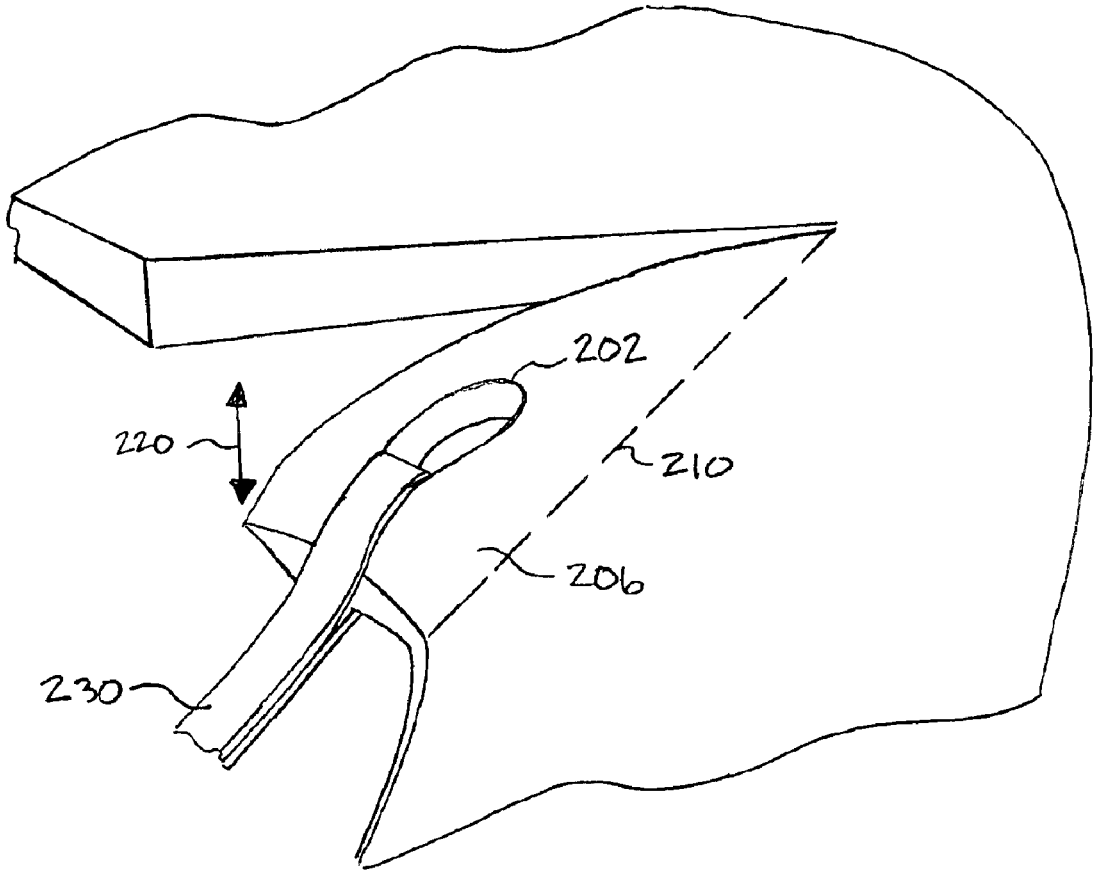
FIG. 2C is schematic diagram of the moveable structure shown in FIGS. 2A and 2B, with the moveable structure shown in a flexed position, according to an embodiment of the present invention.

FIG. 2C illustrates the moveable structure 206 of FIGS. 2A and 2B in a flexed position. In this example, a thong 230 attached to thread hole 202 is pulling moveable structure 206 in the direction of arrow 220. This pull would occur, for example, when a ball is caught or cradled, and comes in contact with thong 230. As shown in FIG. 2C, in response to the pull, moveable structure 206 flexes (along flex line 210) to arrest the movement of the ball and the pocket in a controlled and deadening manner. After moveable structure 206 stops the movement of the ball and pocket, moveable structure 206 then gradually recovers to its original non-flexed position, as shown in FIG. 2B. To provide this gradual recovery, moveable structure 206 dampens the energy of the ball and pocket, rather than storing the energy (as would a spring, for example). This dampening prevents a trampoline effect that would propel the ball out of the pocket. In other words, in response to the pull of the pocket, moveable structure 206 flexes, dampens the pull of the pocket, and then gradually recovers to its original position without excessive rebound.

Figure 3A:
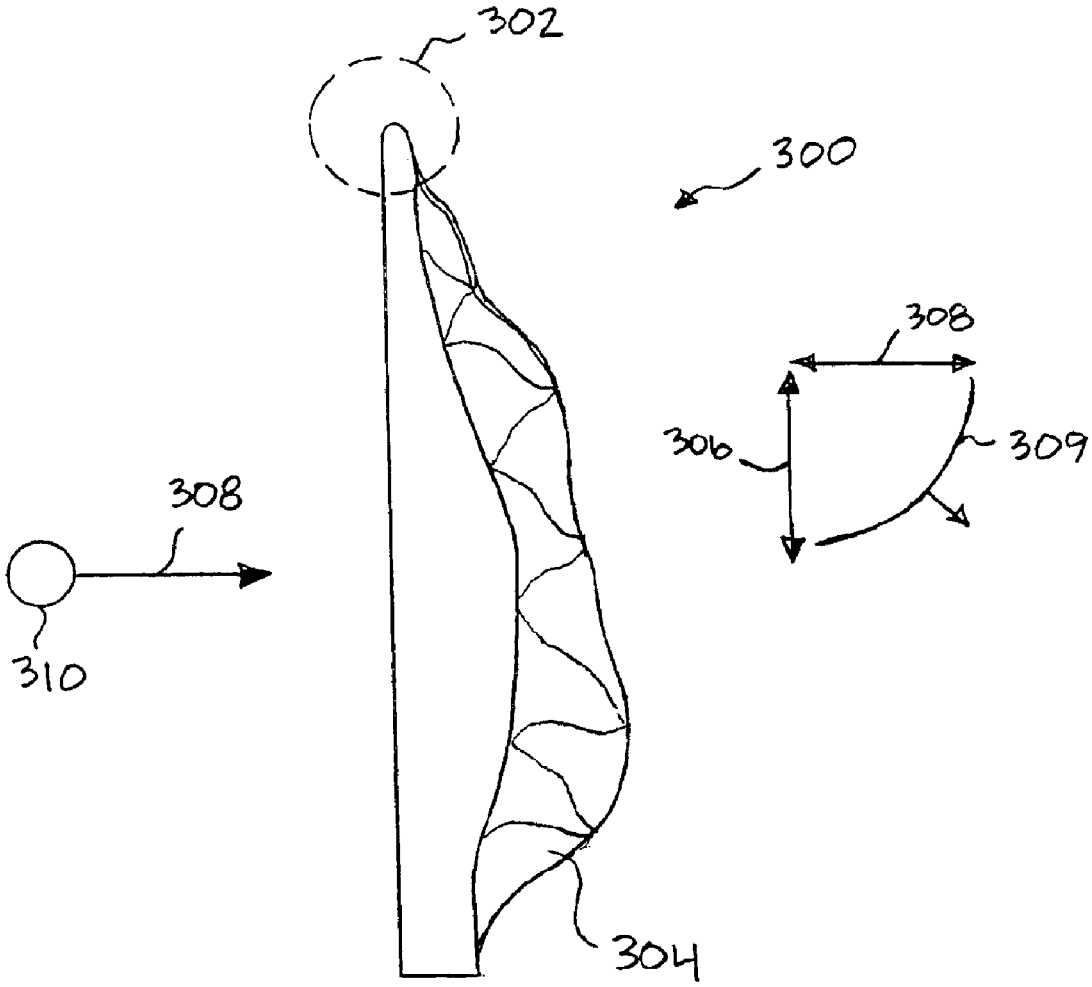
FIG. 3A is a schematic diagram of the present invention applied to the scoop of a lacrosse head, according to an embodiment of the present invention.
Figure 3C:
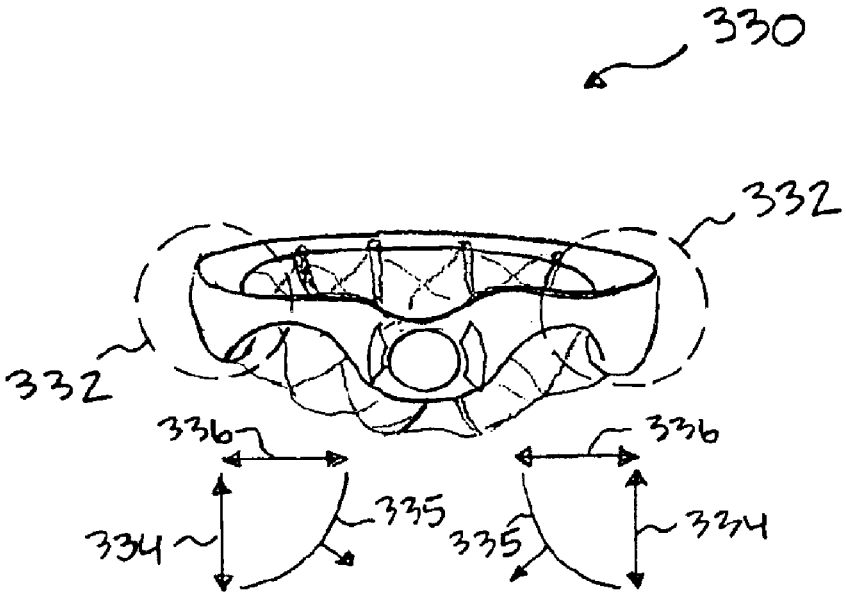
FIG. 3C is a schematic diagram of the present invention applied to the one or more sidewalls of a lacrosse head, according to an embodiment of the present invention.
Figure 3B:
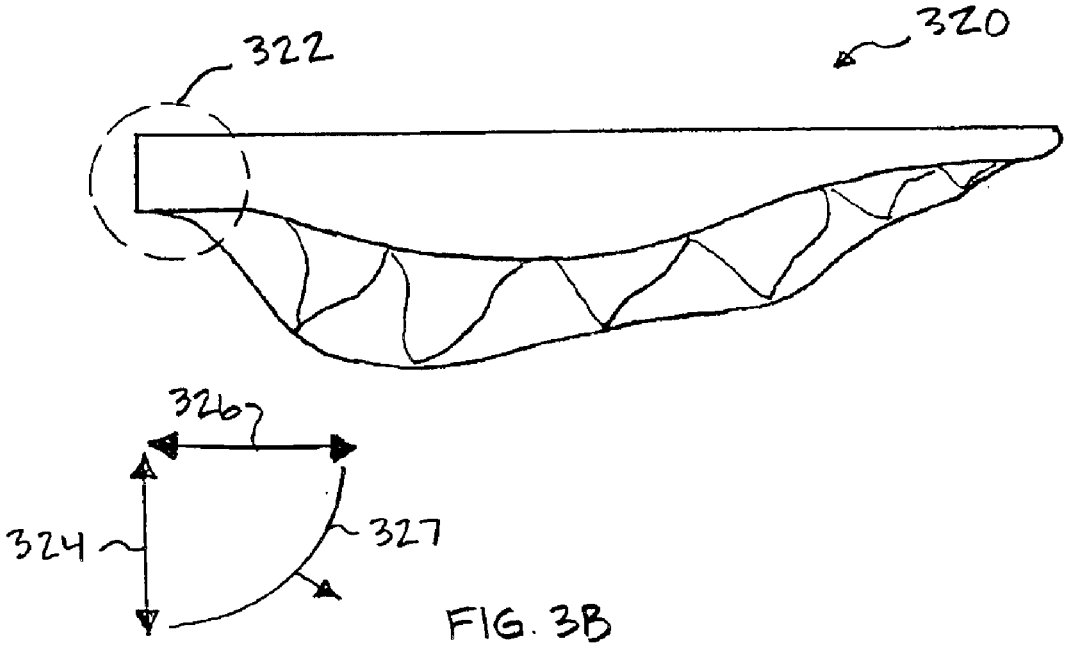
FIG. 3B is a schematic diagram of the present invention applied to the ball stop of a lacrosse head, according to an embodiment of the present invention.

The present invention can be used to attach pocket webbing to any portion of a lacrosse head frame, including the traditional thong and string holes in the scoop, sidewalls, and ball stop. As shown by FIGS. 2A, 2B, and 2C, in any location, the present invention provides a flexible anchor that deflects in response to the pull of a pocket thread, dampens the pull, and then gradually recovers to its original position to limit pocket rebound. The anchor deflects in any direction from substantially parallel to the face of thread hole 202 to perpendicular to the face of thread hole 202. However, because thread hole 202 can face in a different direction, depending on where it is located in the lacrosse head frame, the present invention offers different advantages, depending on whether it is applied to the scoop, sidewalls, or ball stop of a lacrosse head frame. FIGS. 3A, 3B, and 3C illustrate examples of the way in which the present invention can operate in these three different positions.

FIG. 3A shows the present invention applied to the scoop of a lacrosse head 300, as represented by dotted circle 302. In this configuration, a thong attached to thread hole 202 (shown in FIG. 2A) in the scoop provides a dampening flex and gradual recovery in the general direction of arrow 308 after the pocket is impacted by a ball 310 entering the pocket substantially perpendicular to the face of head 300. Specifically, moveable portion 206 (as shown in FIG. 2C) flexes in the general direction of arrow 308 (and arrow 220 in FIG. 2C). Thus, the present invention provides "give" in the general direction of arrow 308, thereby deadening the impact of the ball and the rebound of the pocket. This deadening effect enables a player to more easily control the ball, and keep the ball within the lacrosse head pocket.

Applied to head 300 of FIG. 3A, moveable portion 206 (FIG. 2C) can also provide dampening and gradual recovery characteristics in a direction 306 parallel to the face of head 300, as well as in any of the directions 309 in between arrows 306 and 308. These directions correspond to situations in which, for example, ball 310 enters the pocket in a direction other than perpendicular to the face of head 300, or after the ball is in the pocket and rattles around during cradling.

Thus, when applied to the scoop of a lacrosse head frame, the present invention dampens the movement of the pocket in any of directions 306, 308, and 309. Furthermore, in gradually recovering from flex in any of these directions, the present invention prevents the pocket from acting like a trampoline and ejecting the ball from the pocket prematurely.

FIG. 3B illustrates the present invention applied to the ball stop of a lacrosse head frame 320, as represented by dotted circle 322. In this configuration, a thong attaches to thread hole 202 (shown in FIG. 2A). Moveable portion 206 (as shown in FIG. 2B) provides a dampening and gradual recovery characteristics in a direction generally parallel to the face of head frame 320 (as represented by arrow 326), in a direction generally perpendicular to the face of head frame 320 (as represented by arrow 324), and in any of the directions in between (as represented by arrow 327).

In the direction of arrow 324, the dampening and gradual recovery characteristics are helpful when receiving a ball that is traveling in a direction perpendicular to the face of head frame 320. After the ball impacts the pocket, the pocket pulls against moveable portion 206, which then flexes, dampens the movement of the pocket and ball, and then gradually recovers to its original position to keep the pocket and ball from rebounding out of control.

In the direction of arrow 326, the dampening and gradual recovery characteristics are helpful when a ball is moving within the pocket, such as occurs when cradling or when the lacrosse head is jarred during a defensive check. The present invention therefore dampens the pull of the pocket in the general direction of arrow 326, thereby minimizing the movement of a ball inside the pocket and enabling a player to more easily control the ball, and keep the ball within the lacrosse head pocket. Specifically, when a ball moves within the pocket, causing the suspended pocket to swing, moveable portion 206 flexes, dampens the movement of the pocket and ball, and then gradually recovers to minimize rattle.

In the directions of arrows 327, moveable portion 206 provides dampening and gradual recovery characteristics for situations in which, for example, a ball enters the pocket in a direction other than perpendicular to the face of head frame 320, or after the ball is in the pocket and rattles around in different directions.

FIG. 3C illustrates the present invention applied to one or both of the sidewalls of a lacrosse head frame 330, as represented by dotted circles 332. In this configuration, pocket strings attach to thread hole 202 (shown in FIG. 2A). Moveable portion 206 (as shown in FIG. 2B) provides a dampening and gradual recovery characteristics in a direction generally parallel to the face of head frame 330 (as represented by arrow 336), in a direction generally perpendicular to the face of head frame 330 (as represented by arrow 334), and in any of the directions in between (as represented by arrow 335).

In the direction of arrow 336, the dampening and gradual recovery characteristics are helpful when a ball is moving or swinging within the pocket, such as occurs when cradling or when the lacrosse head is jarred during a defensive check. In this configuration, the present invention therefore dampens the pull of the pocket in the general direction of arrow 336, thereby minimizing the movement of a ball inside the pocket and enabling a player to more easily control the ball, and keep the ball within the lacrosse head pocket. Specifically, when a ball moves within the pocket, causing the suspended pocket to swing, moveable portion 206 flexes, dampens the movement of the pocket and ball, and the gradually recovers to minimize rattle.

In the direction of arrow 334, the dampening and gradual recovery characteristics are helpful when receiving a ball that is traveling in a direction perpendicular to the face of head frame 330. After the ball impacts the pocket, the pocket pulls against moveable portion 206, which then flexes, dampens the movement of the pocket and ball, and then gradually recovers to its original position to keep the pocket and ball from rebounding out of control.

In the directions of arrow 335, moveable portion 206 provides dampening and gradual recovery characteristics for situations in which, for example, a ball enters the pocket in a direction other than perpendicular to the face of head frame 330, or after the ball is in the pocket and rattles around in different directions.

Although, for simplicity, FIGS. 2A, 2B, and 2C show aperture 204 formed in a generally straight line, aperture 204 could be shaped in a variety of ways to create a flex line between a moveable structure and a rigid frame structure of a lacrosse head frame. For example, instead of forming aperture 204 as a straight line, aperture 204 could be formed as a curved line. Alternatively, aperture 204 could be formed as a straight line that changes direction and proceeds in a straight line in another direction (in other words, a "dogleg"). Moreover, aperture 204 could consist of two or more doglegs that enable aperture 204 to surround almost all sides of a thread hole. In this same vein, aperture could be shaped as a long curve that travels around a thread hole, surrounding almost all sides of the thread hole. Of course, aperture 204 could be formed in any combination of shapes as well. For example, aperture could be formed as a straight line with a curved end, in what could be called a "hook" configuration.

Figure 4:
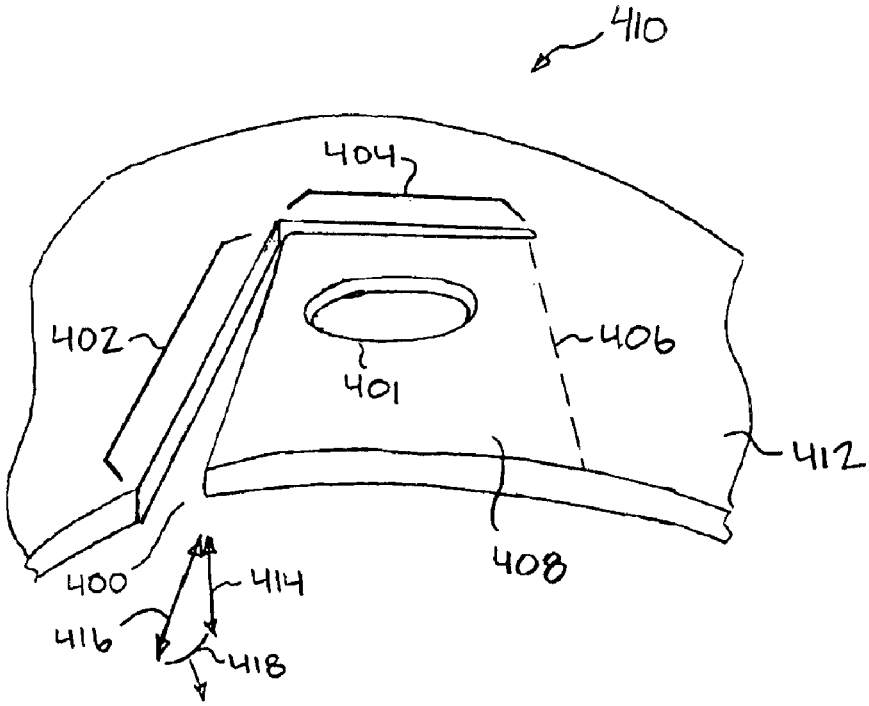
FIG. 4 is a schematic diagram illustrating an aperture having a dogleg shape that encloses a thread hole, according to an embodiment of the present invention.

FIG. 4 illustrates an aperture 400 having a dogleg shape that encloses an oval thread hole 401. As shown, aperture 400 has a first straight section 402 aligned in one direction, connected to a second straight section 404 aligned in another direction. As shown, this shape of aperture 400 creates a flex line 406, which separates a moveable structure 408 of a lacrosse head frame 410 from a rigid portion 412.

In the configuration of FIG. 4, moveable structure 408 provides dampening and gradual recovery characteristics in the general direction of arrow 414 (generally perpendicular to the face of thread hole 401) by bending along flex line 406. In addition, moveable structure 408 provides dampening and gradual recovery characteristics in the general direction of arrow 416 (generally parallel to the face of thread hole 401) by compression and elasticity roughly along flex line 406. Specifically, the material of frame 410 stretches along flex line 406 at points near second straight section 404 and compresses at the opposite end of flex line 406 near the edge of frame 410. Finally, moveable structure 408 also provides dampening and gradual recovery characteristics in directions 418 in between arrows 414 and 416 by combinations of bending, compressing, stretching, and even twisting along flex line 406.

Figure 5:
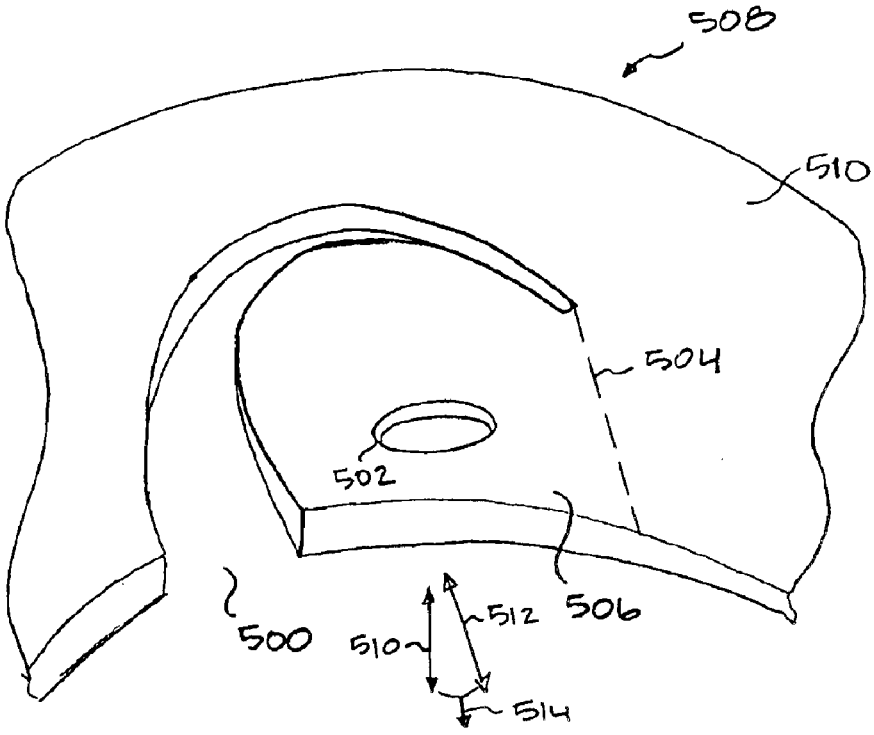
FIG. 5 is a schematic diagram illustrating an aperture having a curved shape that circles around a thread hole, according to an embodiment of the present invention.

FIG. 5 illustrates an aperture 500 having a curved shape that partially circles around a circular thread hole 502. As shown, aperture 500 surrounds a majority of the perimeter of thread hole 502. The curved shape of aperture 500 creates a flex line 504, separating a moveable structure 506 of a lacrosse head frame 508 from a rigid portion 510.

In the configuration of FIG. 5, moveable structure 506 provides dampening and gradual recovery characteristics in the general direction of arrow 510 (generally perpendicular to the face of thread hole 502) by bending along flex line 504. In addition, moveable structure 506 provides dampening and gradual recovery characteristics in the general direction of arrow 512 (generally parallel to the face of thread hole 502) by compression and elasticity roughly along flex line 504. Specifically, the material of frame 510 stretches along flex line 504 at points near aperture 500 and compresses at the opposite end of flex line 504 near the edge of frame 510. Finally, moveable structure 506 also provides dampening and gradual recovery characteristics in directions 514 in between arrows 510 and 512 by combinations of bending, compressing, stretching, and twisting along flex line 504.

Figure 6:
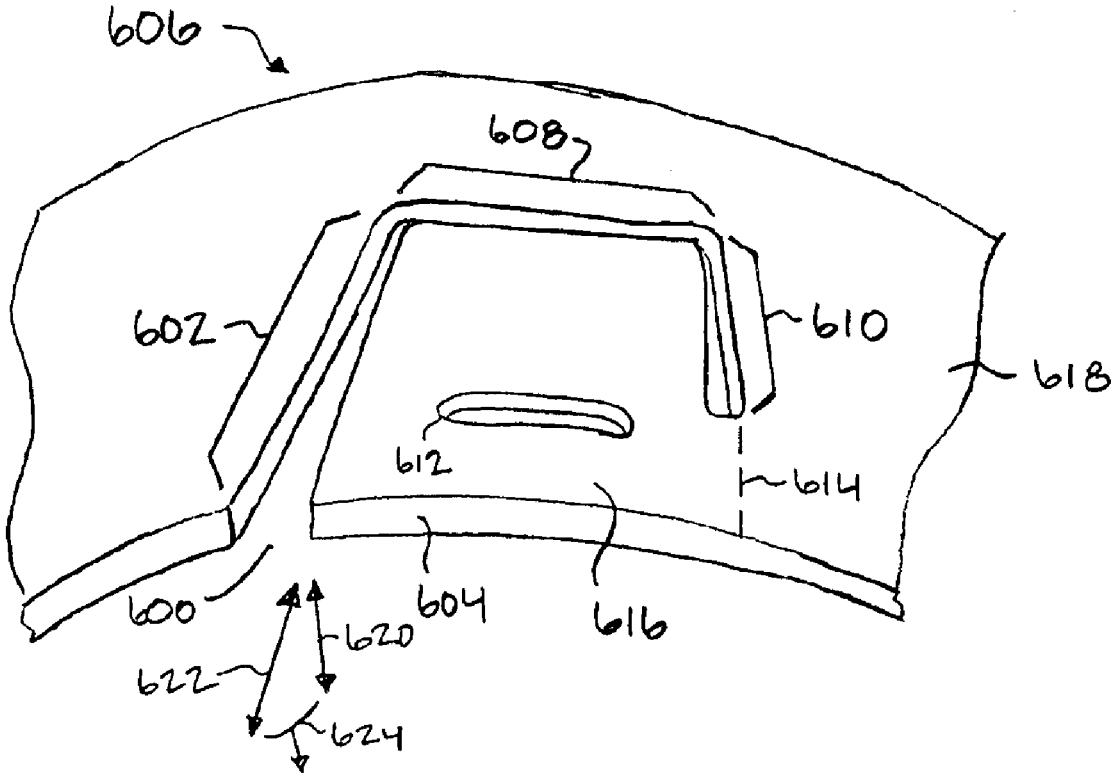
FIG. 6 is a schematic diagram illustrating an aperture having a multiple-dogleg shape, according to an embodiment of the present invention.

FIG. 6 illustrates an aperture 600 having a multiple-dogleg shape. A first straight section 602 is positioned substantially perpendicular to the edge 604 of the lacrosse head frame 606. A second straight section 608 is positioned substantially parallel to edge 604 and substantially perpendicular to the first straight section 602. A third straight section 610 extends back toward edge 604 and is positioned substantially perpendicular to edge 604 and the second straight section 608, and substantially parallel to the first straight section 602. The entire length of aperture 600 therefore surrounds a majority of the perimeter of slit-shaped thread hole 612, creating a flex line 614 between moveable portion 616 and rigid portion 618.

In the configuration of FIG. 6, moveable structure 616 provides dampening and gradual recovery characteristics in the general direction of arrow 620 (generally perpendicular to the face of thread hole 612) by bending along flex line 614. In addition, moveable structure 616 provides dampening and gradual recovery characteristics in the general direction of arrow 622 (generally parallel to the face of thread hole 612) by compression and elasticity roughly along flex line 614. Specifically, the material of frame 606 stretches along flex line 614 at points near section 610 of aperture 600 and compresses at the opposite end of flex line 614 near the edge of frame 606. In comparison to apertures 400 and 500 of FIGS. 4 and 5, respectively, aperture 600 of FIG. 6 surrounds a greater portion of thread hole 612, thereby creating a shorter flex line 614 and increasing the tendency of moveable structure 616 to move in the direction of arrow 622. In other words, because the portion of frame 606 that is joining moveable structure 616 to rigid structure 618 is small, moveable structure 616 is able to flex more (e.g., by compression and elasticity) in a plane parallel to the face of thread hole 612. Finally, moveable structure 616 also provides dampening and gradual recovery characteristics in directions 624 in between arrows 620 and 622 by combinations of bending, compressing, stretching, and twisting along flex line 614.

FIGS. 7–10 illustrate a lacrosse head 700 having apertures 702 around scoop thread holes 704, sidewall thread holes 800, and ball stop thread holes 900. In this example, each aperture 702 has a curved shape that circles a majority of the perimeter of thread holes 704, 800, and 900. Each aperture 702 therefore provides a flex line, a moveable structure, and a rigid frame structure, as described above. In suspending the pocket webbing from thread holes 704, 800, and 900, the moveable structures provide dampening and gradual recovery characteristics in multiple directions, as described above. The moveable structures flex from the pull of strings under tension, as occurs, for example, when a ball impacts the pocket of the lacrosse head and stretches the pocket in the direction in which the ball is traveling. The moveable structures recover gradually to their original positions.

Figure 7:
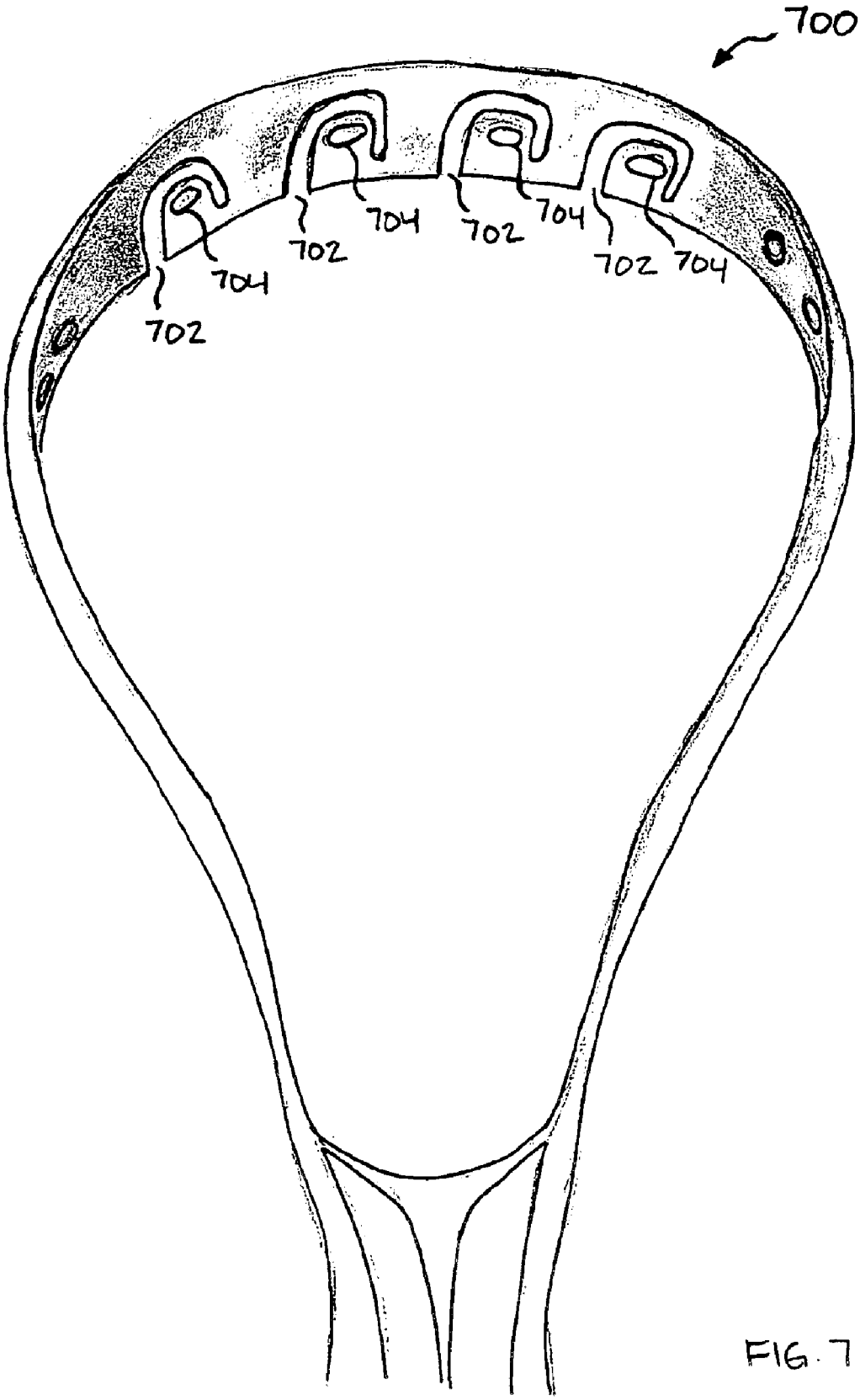
FIGS. 7–10 are schematic diagrams of a lacrosse head having apertures around scoop thread holes, sidewall thread holes, and ball stop thread holes, according to an embodiment of the present invention.

In a further embodiment of the present invention, FIGS. 7–10 also demonstrate the different ways in which apertures around adjacent thread holes can be configured. For instance, FIG. 7 shows all apertures 702 of a scoop circling thread holes 704 in a clockwise direction. However, as one of ordinary skill in the art would appreciate, apertures 704 could be configured in a counterclockwise direction. Moreover, adjacent apertures 704 could be configured in alternating directions, such that a first aperture is in a clockwise direction and a second aperture adjacent to the first is in a counterclockwise direction. Essentially, pairs and groups of apertures 704 could be arranged in any number of clockwise and counterclockwise arrangements.

Figure 8:
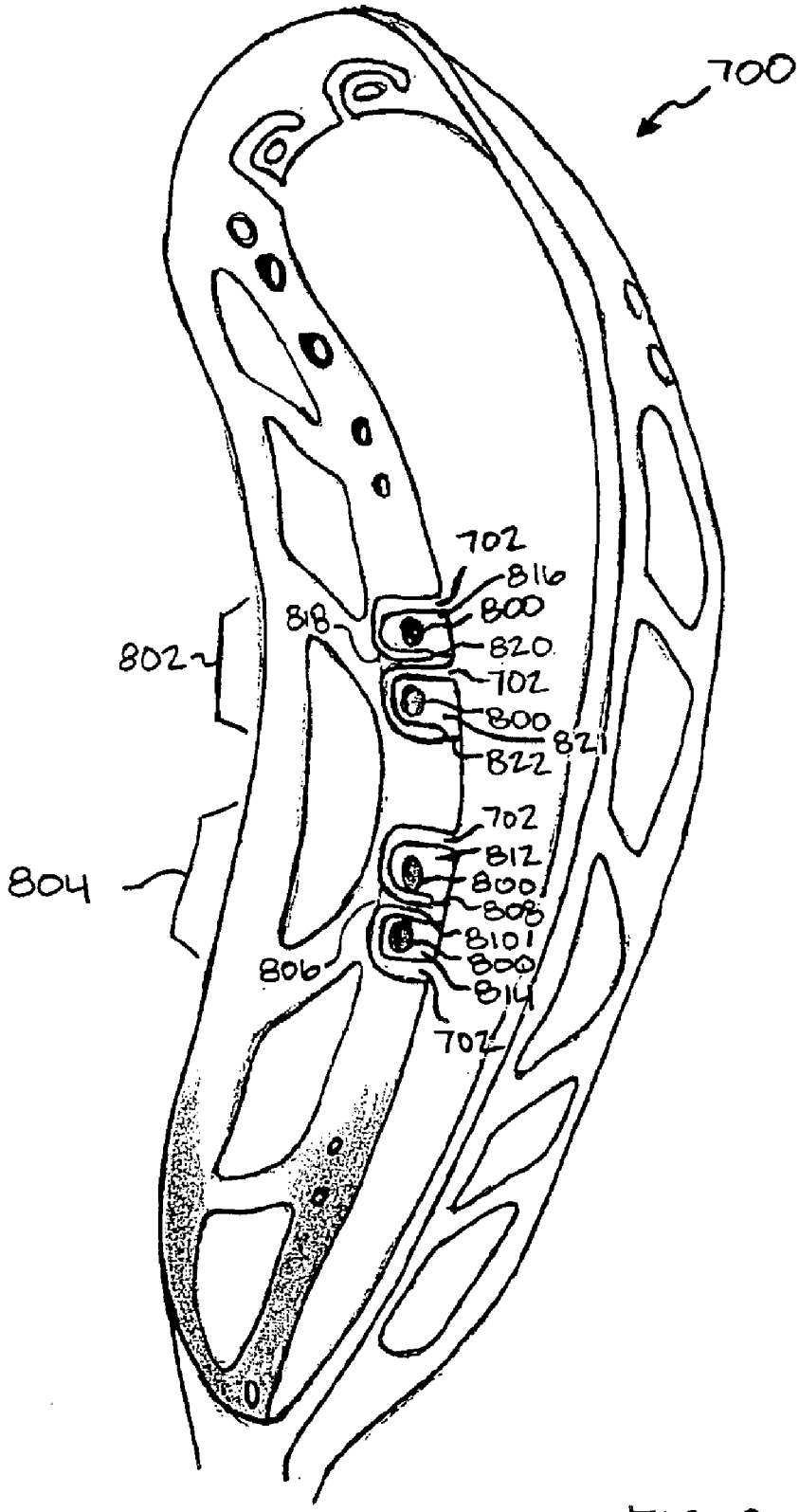

FIG. 8 shows two examples for arranging pairs of apertures 702. In a first pair 802 of adjacent apertures 702, both apertures circle thread holes 800 in a counterclockwise direction. In a second pair 804 of adjacent apertures 702, one aperture circles its thread hole 800 in a clockwise direction, while the second adjacent aperture circles its thread hole 800 in a counterclockwise direction.

Figure 9:
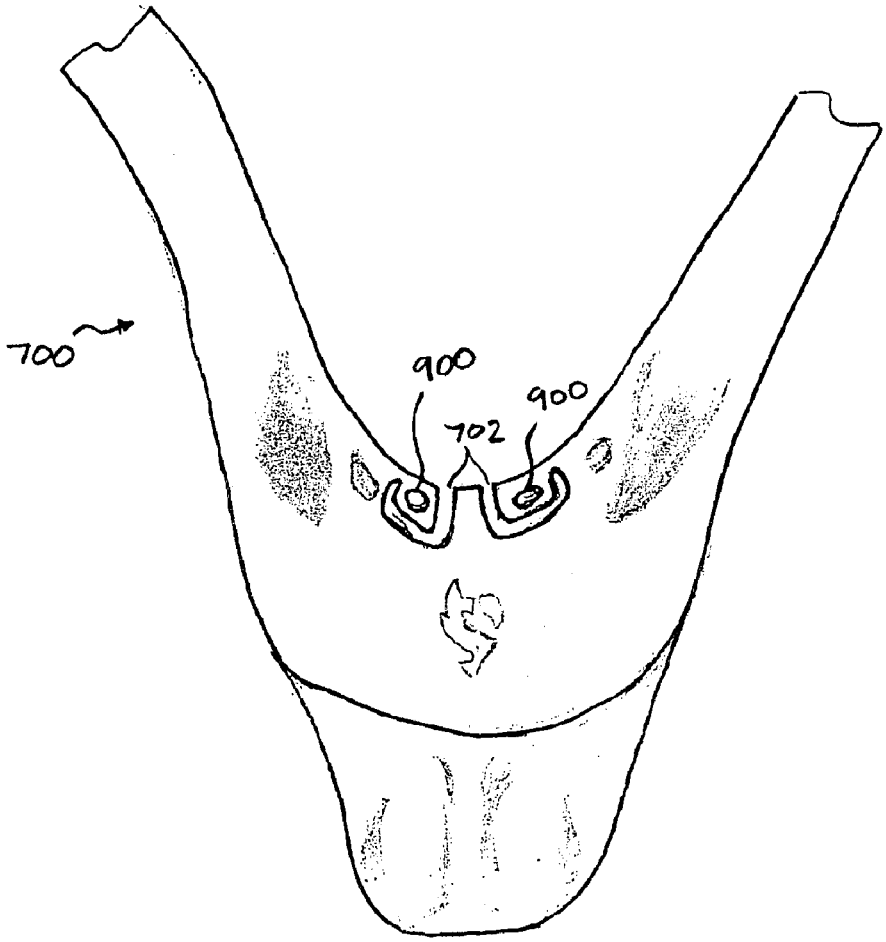
Figure 10:
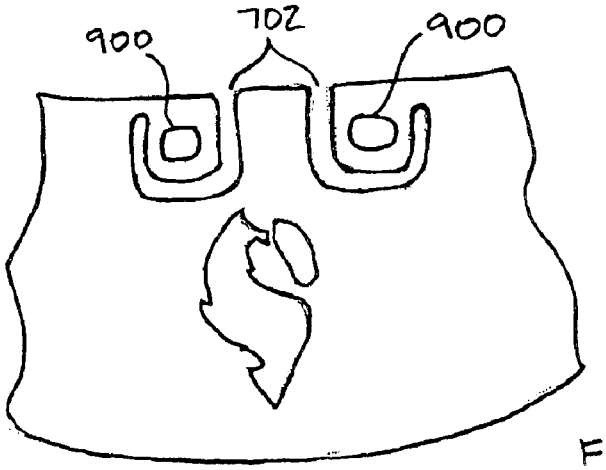

FIGS. 9 and 10 show two adjacent apertures 702 around ball stop thread holes 900. Looking from the back of the ball stop, one aperture circles its thread hole 900 in a counterclockwise direction, while the second adjacent aperture circles its thread hole 900 in clockwise direction.

The various ways in which to configure the directions of adjacent apertures each provide a different degree of flex. In addition to the configuration, the proximity of adjacent apertures also greatly affects the degree of flex. As an example, the widely spaced apertures 702 of FIGS. 7, 9, and 10 have little effect on each other. In other words, the moveable structure created by each aperture moves in substantially the same manner, relative to the rigid frame structure. In contrast, the closely positioned, opposing-direction apertures of aperture pair 804 in FIG. 8 tend to create another flex line 806, in addition to flex lines 808 and 810. Thus, in this case, the proximity of the apertures 702 provides a further degree of flex for both moveable portions 812 and 814.

As another example, in FIG. 8 the closely positioned, same-direction apertures of aperture pair 802 create an added flex similar to that of pair 804, but this time only for one of the moveable structures (moveable structure 816). As shown, the proximity of the apertures of pair 802 provides an additional flex line 818 for moveable structure 816. Thus, moveable structure 816 flexes along lines 818 and 820. The other moveable portion 821 is unaffected by the proximity, flexing only along flex line 822.

Figure 11:
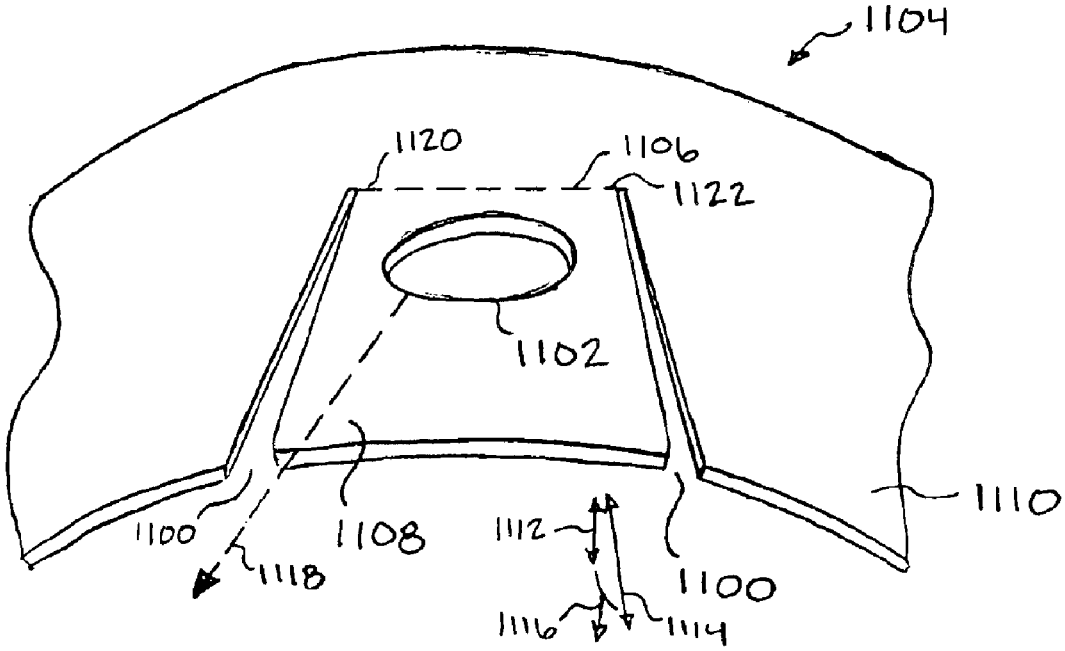
FIG. 11 is a schematic diagram illustrating an embodiment of the present invention in which two apertures are positioned around a thread hole on a lacrosse head frame.

FIG. 11 illustrates another embodiment of the present invention in which two apertures 1100 are positioned around a thread hole 1102 on a lacrosse head frame 1104. On a line connecting apertures 1100, this embodiment creates a flex line 1106. On the side of the flex line containing thread hole 1102, the two apertures 1100 create a moveable structure 1108, which moves relative to the remaining rigid frame structure 1110 of frame 1104. Thus, moveable structure 1108 is able to flex or "give" along flex line 1106 relative to the rigid frame structure 1110.

In the configuration of FIG. 11, by bending along flex line 1106, moveable structure 1108 provides dampening and gradual recovery characteristics in a direction 1112, which is generally perpendicular to the face of thread hole 1102.

Moveable structure 1108 can also provide dampening and gradual recovery characteristics in a plane 1114 generally parallel to the face of thread hole 1102, depending on the direction in which a thread is pulling thread hole 1102. For example, a thread pulling in direction 1118 would tend to compress the material of frame 1104 at locations along flex line 1106 near point 1120, and would tend to stretch the material of frame 1104 at locations along flex line 1106 near point 1122. As a result, moveable structure 1108 would flex within plane 1114 in the direction of arrow 1118.

Movement in plane 1114 can also be provided by adjusting the material properties (e.g., thinned, perforated, or scored material) along flex line 1106 to create different elasticity and compression characteristics.

Moveable structure 1108 can also provide dampening and gradual recovery characteristics in directions 1116 in between directions 1112 and 1114 through combinations of the bending, compressing, and stretching described above.

Figure 12:
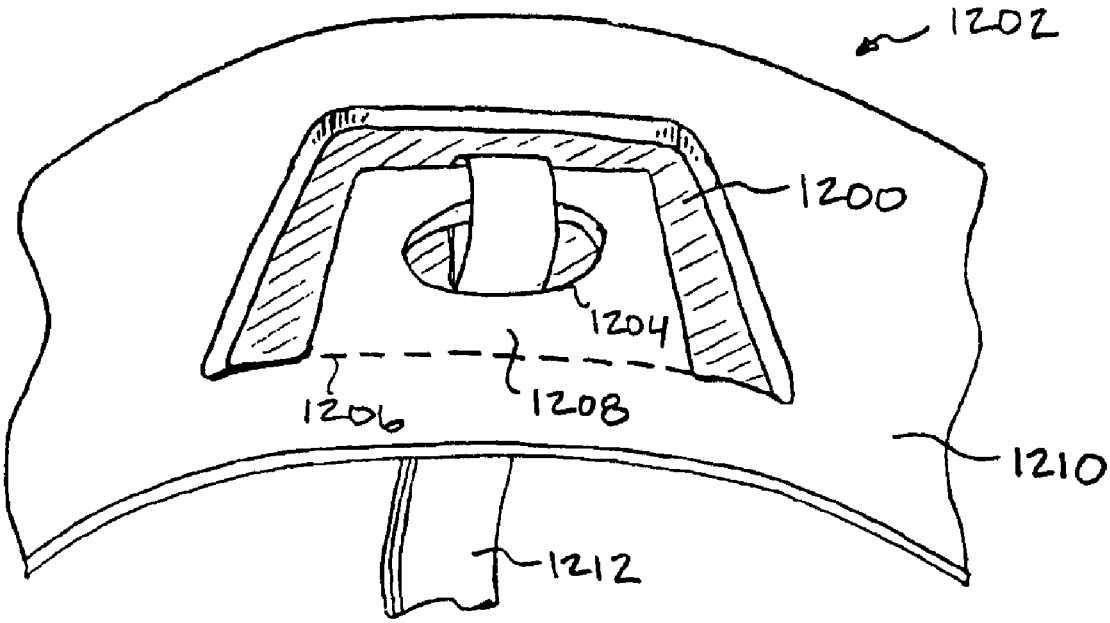
FIG. 12 is a schematic diagram illustrating an aperture that is interior to a lacrosse head frame, according to an embodiment of the present invention.

In another embodiment of the present invention, FIG. 12 illustrates an aperture 1200 that is interior to a lacrosse head frame 1202. In other words, aperture 1200 does not reach or open to an edge of lacrosse head frame 1202, as do the apertures shown in FIGS. 2–11. In this embodiment, aperture 1200 surrounds a majority of the perimeter of a thread hole 1204, in a shape akin to three sides of a square. This configuration creates a flex line 1206, which separates lacrosse head frame 1202 into a moveable structure 1208 and a rigid frame structure 1210. When pulled by pocket webbing 1212 (which, in this example, is a thong) in a direction generally perpendicular to the face of thread hole 1204, moveable structure 1208 flexes along flex line 1206 and relative to rigid frame structure 1210 to provide the dampening of the present invention.

Figure 13:
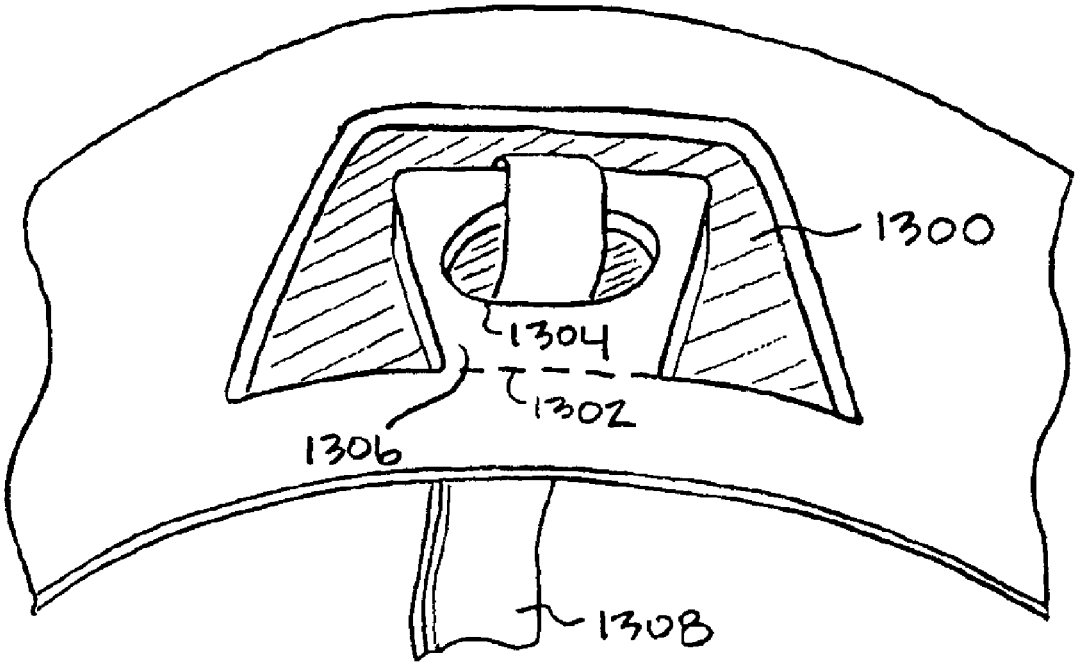
FIG. 13 is a schematic diagram illustrating an interior aperture that provides a shorter flex line in comparison to the aperture of FIG. 12, according to an embodiment of the present invention.

FIG. 13 illustrates another example of an interior aperture 1300. In comparison to FIG. 12, aperture 1300 provides a shorter flex line 1302 because aperture 1300 surrounds more of the perimeter of thread hole 1304, than does aperture 1200 surround thread hole 1204. The shorter flex line 1302 enables moveable structure 1306 to flex more easily in response to a pocket webbing 1308 (which, in this example, is a thong) pulling in a direction generally perpendicular to the face of thread hole 1304.

Figure 14:
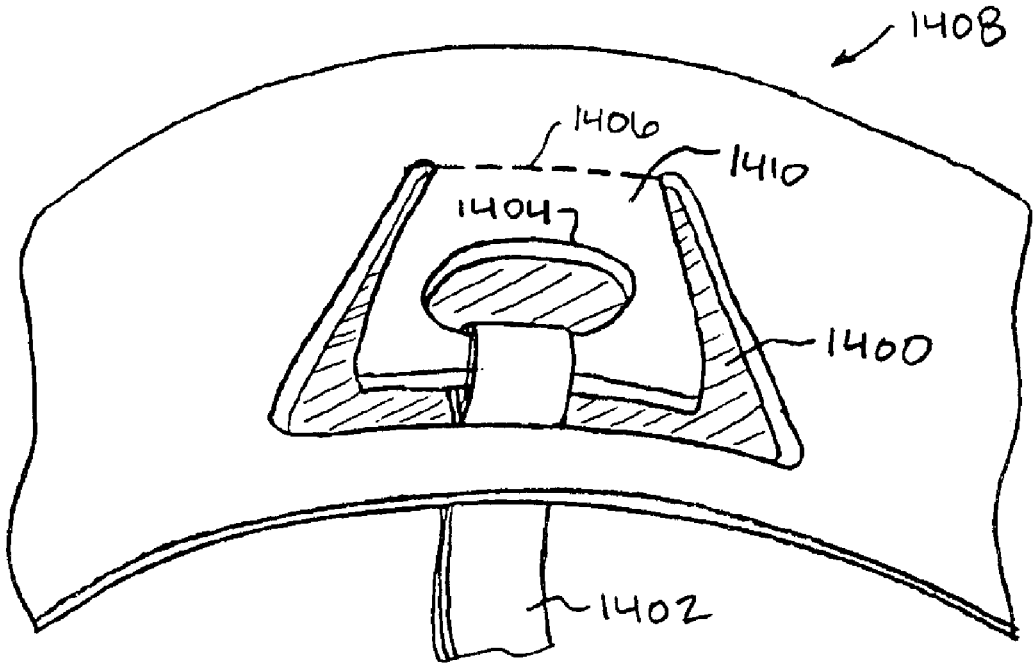
FIG. 14 is a schematic diagram illustrating an alternative orientation for an interior aperture, according to an embodiment of the present invention.

FIG. 14 illustrates an alternate orientation for an interior aperture 1400, and the corresponding way in which a pocket webbing 1402 is attached. As shown, aperture 1400 surrounds a majority of the perimeter of thread hole 1404 and creates a flex line 1406 on a side of thread hole 1404 opposite the pocket of the lacrosse head frame 1408. Moveable structure 1410 flexes in response to a pull from pocket webbing 1402 in a direction generally perpendicular to the face of thread hole 1404. In addition, depending on the direction in which webbing 1402 pulls, the configuration of FIG. 14 provides the same dampening and gradual recovery characteristics discussed with reference to FIG. 11.

As one of ordinary skill in the art would appreciate, an interior aperture could be oriented in any number of ways to make the moveable structure flex along a particular flex line.

Figure 15:
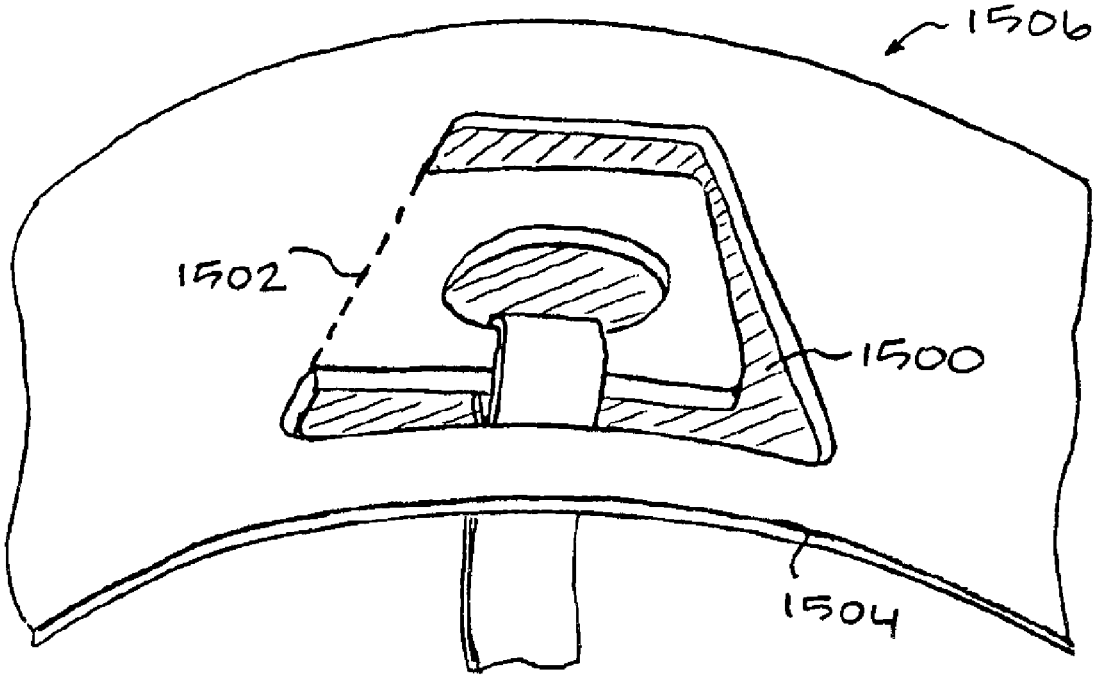
FIG. 15 is a schematic diagram illustrating an aperture that creates a flex line that is roughly perpendicular to the edge of a lacrosse head frame, according to an embodiment of the present invention.
Figure 16:
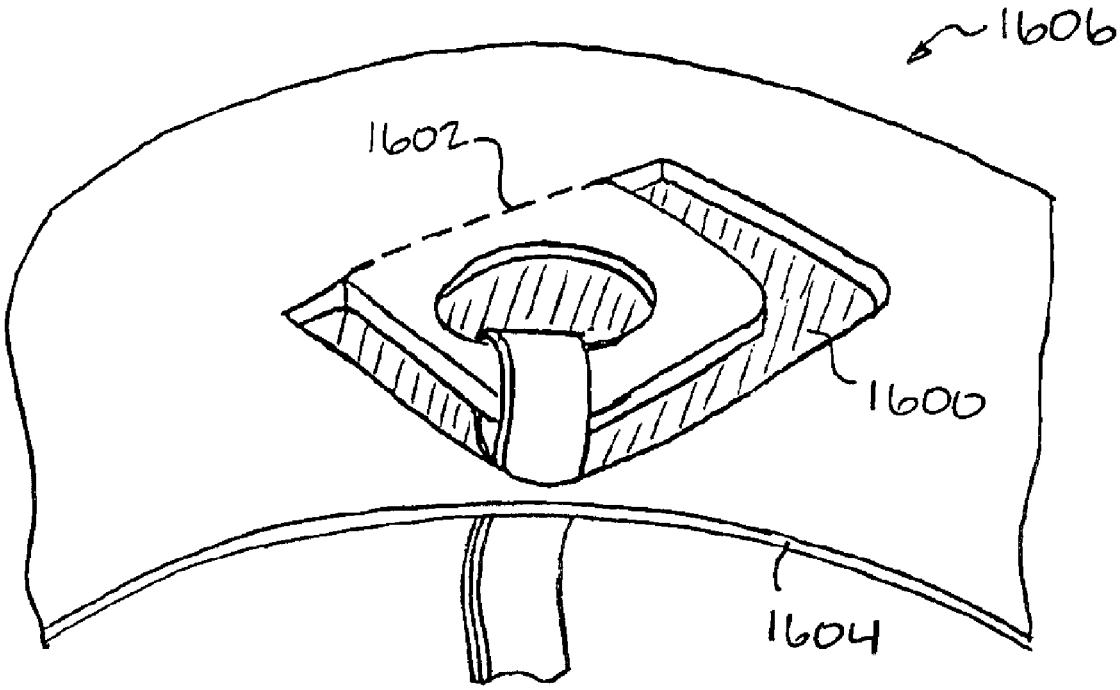
FIG. 16 is a schematic diagram illustrating an aperture that creates a flex line that is at roughly a 45-degree angle to the edge of a lacrosse head frame, according to an embodiment of the present invention.

As another example, FIG. 15 shows an aperture 1500 that creates a flex line 1502 that is roughly perpendicular to the edge 1504 of a lacrosse head frame 1506. As another example, FIG. 16 shows an aperture 1600 that creates a flex line 1602 that is at an angle (e.g., a 45 degree angle) to the edge 1604 of a lacrosse head frame 1606.

Figure 17:
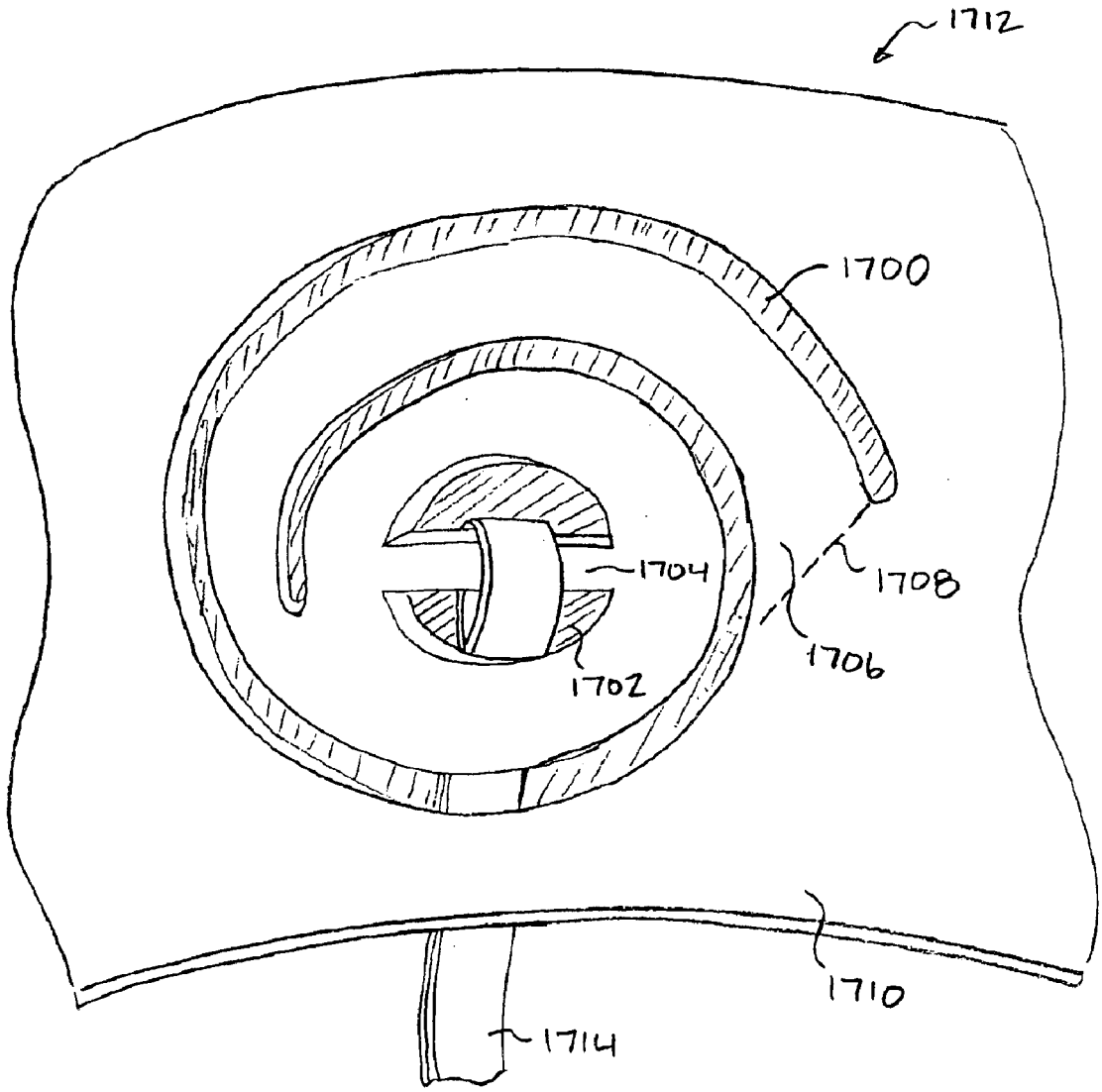
FIG. 17 is a schematic diagram illustrating a spiral aperture and a thread hole having a webbing bar, according to an embodiment of the present invention.

FIG. 17 illustrates another embodiment of the present invention, which includes a spiral aperture 1700 and a thread hole 1702 having a webbing bar 1704. Spiral aperture 1700 surrounds all of thread hole 1702, creating an interior spiral moveable structure 1706 that flexes at flex line 1708 relative to the remaining rigid frame structure 1710 of lacrosse head frame 1712. Moveable structure 1706 also flexes along its length by the twisting or bending of the material from which moveable structure 1700 is formed.

Although FIG. 17 shows spiral aperture 1700 wrapping around thread hole 1702 approximately 1½ times, spiral aperture 1700 could wrap one or more times around thread hole 1702, depending on the desired dampening effect. The more times that spiral aperture 1700 circles thread hole 1702, the more that moveable structure 1706 is able to flex and dampen the pull of pocket webbing 1714. Webbing bar 1704 of thread hole 1702 provides a member around which pocket webbing 1714 can be strapped so that it does not interfere with the movement of moveable structure 1706.

FIGS. 18A–18D illustrate an alternative embodiment of the present invention in which a moveable portion 1800 is specially shaped to provide additional dampening deflection. Specifically, moveable portion 1800 is curved in its original, non-flexed position. Then, when a force is applied to moveable structure 1800, the curved portion 1804 of moveable structure 1800 deflects and straightens. This alternative embodiment could be applied to any of the embodiments described above.

Figure 18A:
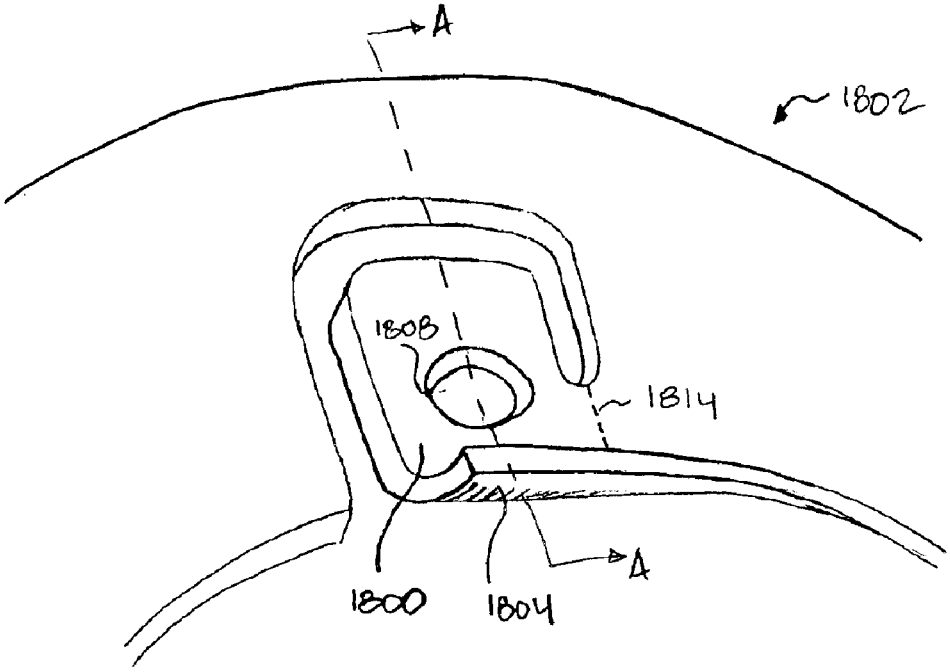
FIG. 18A is a schematic diagram illustrating a lacrosse head frame having an exemplary moveable portion that provides additional dampening deflection, according to an embodiment of the present invention.

FIG. 18A shows moveable portion 1800 in the scoop of a lacrosse head frame 1802. Moveable portion 1800 has a thread hole 1808 and is configured similarly to the structure shown in FIGS. 7–10, but includes a curved portion 1804 at the inside edge of the scoop.

Figure 18B:
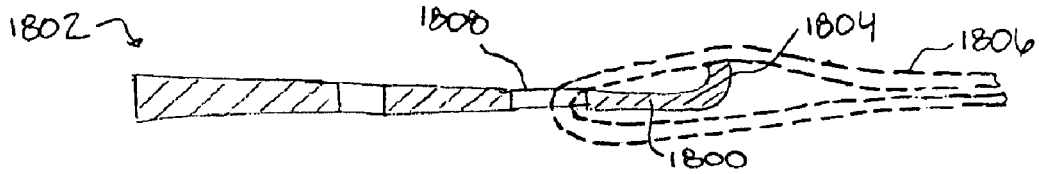
FIG. 18B is a schematic diagram of a cross-section of the lacrosse head frame of FIG. 18A along line A—A, shown in a non-flexed position, according to an embodiment of the present invention.
Figure 18C:
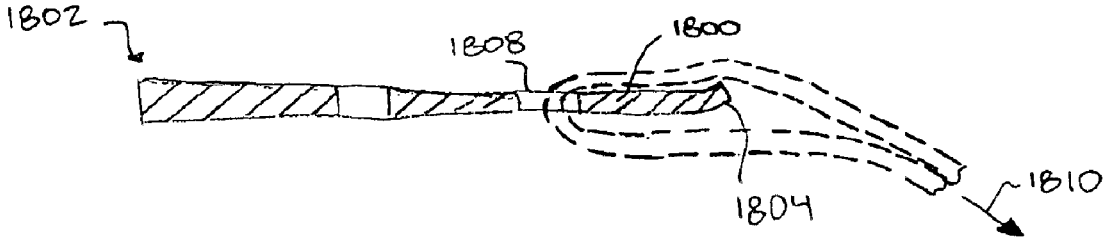
FIG. 18C is a schematic diagram of a cross-section of the lacrosse head frame of FIG. 18A along line A—A, shown in a flexed position, according to an embodiment of the present invention.

FIGS. 18B and 18C illustrate a cross-section of moveable structure 1800 along section A—A of FIG. 18A. FIG. 18B shows moveable structure 1800 in its original, non-flexed position, with a thong 1806 threaded through thread hole 1808 and over curved portion 1804. FIG. 18C shows moveable structure 1800 in a deflected position, with curved portion 1804 at least partially straightened out by thong 1806 pulling in direction 1810.

Figure 18D:
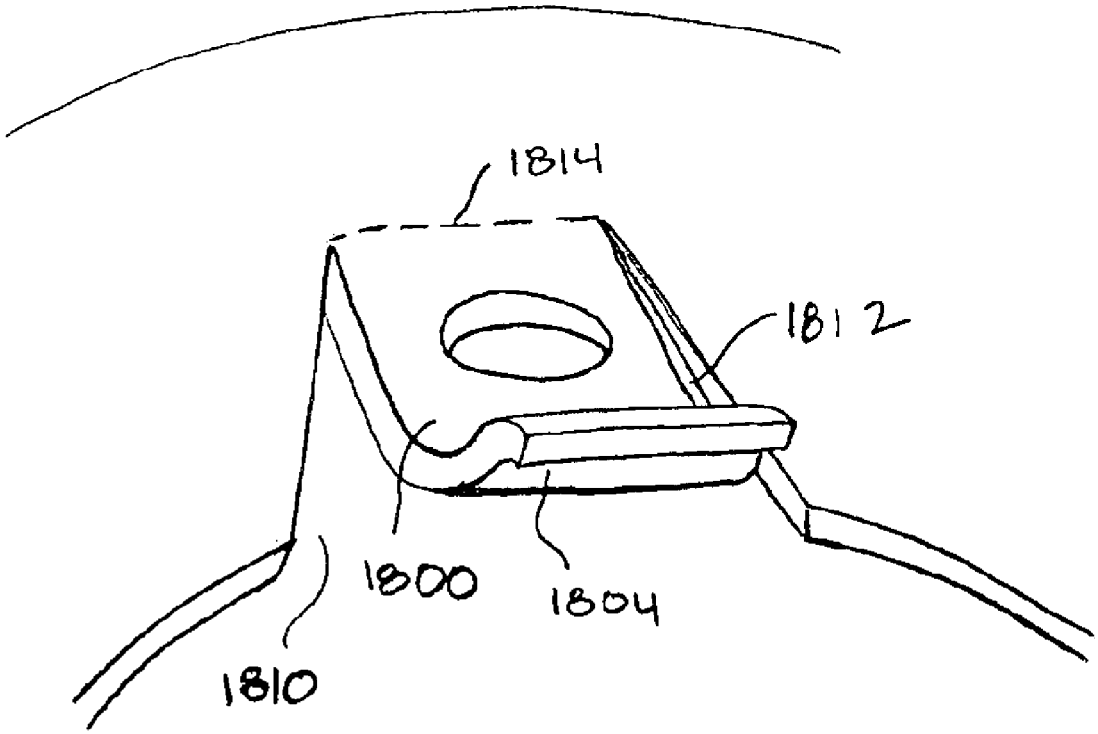
FIG. 18D is a schematic diagram illustrating a lacrosse head frame having an exemplary moveable portion that provides additional dampening deflection, according to another embodiment of the present invention.

As another embodiment, FIG. 18D shows a curved portion 1804 applied to a moveable structure 1800 having two apertures 1810 and 1812. In this example, moveable portion 1804 is configured similarly to the structure shown in FIG. 11, but includes a curved portion 1804.

As illustrated in the example configurations of FIGS. 18A–18D, a moveable structure with a deflectable shape (e.g., curved) provides dampening and gradual recovery characteristics beyond those derived from one or more apertures (e.g., in bending, twisting, compressing, or stretching along flex line 1814). Deflecting the shape of the moveable structure provides additional dampening against the pull of a pocket thread. In addition, in gradually returning to its original deflectable shape, the moveable structure helps avoid pocket rebound and ejection of a ball.

As discussed above, the present invention provides a beneficial pocket dampening when applied to one or more of the sidewalls, scoop, and stop portions of a lacrosse head. This benefit is particularly useful for a lacrosse head that is made of just one substantially rigid material (e.g., ST-801 nylon manufactured by DuPont), as has been the convention since double-wall synthetic heads were first introduced around 1970. Using apertures that create moveable structures within a lacrosse head frame, the present invention provides a desirable pocket dampening on a frame made of substantially rigid material.

Although the present invention works with a lacrosse head made of a single material, lacrosse heads of the present invention can be made of more than one material to enhance the benefits of the invention. As an example, in any of the above-described embodiments, the rigid frame structure could be made of any of the well-known lacrosse head materials (such as nylon or polycarbonate), while the moveable structure could be made of a different, more pliable material, such as an elastomer. In this manner, the moveable structure would not only flex along the flex line created by the aperture, but would itself bend, twist, stretch, etc. (more so than a moveable structure made of the first substantially rigid material) and further absorb energy introduced by the moving ball and pocket.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A lacrosse head comprising:

a frame member having a first side and a second side generally opposite the first side, wherein the frame member has a thread hole from the first side to the second side adapted to receive a pocket thread; and an aperture from the first side to the second side proximate to the thread hole, wherein the aperture creates a moveable structure of the frame member, wherein the moveable structure encompasses at least a portion of the thread hole, and wherein the moveable structure is adapted to flex relative to the frame member.

2. The lacrosse head of claim 1, wherein the thread hole has a face, and wherein the movable structure flexes in one of a first direction generally perpendicular to the face of the thread hole, a second direction generally parallel to the face of the thread hole, and in a third direction in between the first direction and second direction.

3. The lacrosse head of claim 1, wherein the aperture surrounds all of the perimeter of the thread hole.

4. The lacrosse head of claim 3, wherein the aperture is a spiral aperture around the thread hole.

5. The lacrosse head of claim 1, wherein the thread hole has a face and the lacrosse head further comprises a pocket thread attached to the thread hole, wherein the pocket thread pulls the moveable structure in a direction generally perpendicular to the face of the thread hole.

6. The lacrosse head of claim 1, wherein the thread hole has a face, and wherein the moveable structure flexes in a direction generally perpendicular to the face of the thread hole.

7. The lacrosse head of claim 1, wherein the aperture is interior to the frame.

8. The lacrosse head of claim 1, wherein the frame comprises a stop member, two sidewalls connected to the stop member, and a scoop connected to the two sidewalls opposite the stop member, wherein the thread hole and the aperture are in the stop member, and wherein the aperture opens to an edge of the stop member.

9. The lacrosse head of claim 1, wherein the frame comprises a stop member, two sidewalls connected to the stop member, and a scoop connected to the two sidewalls opposite the stop member, wherein the thread hole and the aperture are in a sidewall of the two sidewalls, and wherein the aperture opens to an edge of the sidewall.

10. The lacrosse head of claim 1, wherein the lacrosse head comprises a stop member, two sidewalls connected to the stop member, and a scoop connected to the two sidewalls opposite the stop member, wherein the frame member is the scoop, wherein the thread hole and the aperture are in the scoop, and wherein the aperture opens to an edge of the scoop.

11. The lacrosse head of claim 1, further comprising a second aperture proximate to the thread hole, wherein the second aperture further defines the moveable structure.

12. The lacrosse head of claim 11, wherein the moveable structure flexes relative to the frame generally along a line connecting the aperture to the second aperture.

13. The lacrosse head of claim 1, wherein the moveable structure includes a curved portion adapted to deflect.

14. The lacrosse head of claim 1, further comprising a handle attached to the lacrosse head.

15. A lacrosse head comprising:

a frame having a thread hole adapted to receive a pocket thread; and an aperture proximate to the thread hole, wherein the aperture creates a moveable structure of the frame, wherein the moveable structure encompasses at least a portion of the thread hole, and wherein the moveable structure is adapted to flex relative to the frame, and wherein the aperture surrounds a majority of the perimeter of the thread hole.

16. A lacrosse head comprising:

a frame member having a first side and a second side generally opposite the first side; and an aperture in the frame member from the first side to the second side, wherein the aperture forms a moveable structure from a portion of the frame member, wherein the moveable structure flexes relative to the frame member, and wherein a thread hole is disposed from the first side to the second side in at least a portion of the moveable structure.

17. The lacrosse head of claim 16, wherein the frame member is one of perforated and scored in between the moveable structure and the frame member.

18. The lacrosse head of claim 16, wherein the aperture is interior to the frame.

19. The lacrosse head of claim 16, wherein the aperture opens to an edge of the frame member.

20. The lacrosse head of claim 16, further comprising a handle attached to the frame member.

21. A lacrosse head comprising:

a frame; and an aperture in the frame, wherein the aperture forms a moveable structure from a portion of the frame, wherein the moveable structure flexes relative to the frame, and wherein a thread hole is disposed in at least a portion of the moveable structure, and wherein the aperture surrounds a majority of the perimeter of the thread hole.

22. A lacrosse head comprising:

a frame members comprising:

a stop member, wherein the stop member has stop member thread openings that are adapted to receive pocket threads;

sidewalls extending from the stop member, wherein the sidewalls have sidewall thread openings adapted to receive pocket threads; and a transverse wall joining the sidewalls at their end opposite to the stop member, wherein the transverse wall has transverse wall thread openings adapted to receive pocket threads; and at least one aperture in a frame member proximate to one opening of the frame member, the one opening being one of the sidewall thread openings, the transverse wall thread openings, and the stop member thread openings, wherein the at least one aperture and the one opening penetrate the frame member from a first side of the frame member to a second side of the frame member generally opposite the first side, wherein the at least one aperture creates a moveable portion of the frame member that flexes relative to a remaining portion of the frame member, and wherein the one opening is disposed in at least a part of the moveable portion.

23. The lacrosse head of claim 22, further comprising a pocket thread attached to the one opening, wherein the moveable portion flexes in response to a pull by a pocket thread attached to the one opening.

24. The lacrosse head of claim 22, wherein the moveable structure flexes in a direction generally perpendicular to a face of the one opening.

25. The lacrosse head of claim 22, wherein the at least one aperture comprises a first aperture and a second aperture, wherein the first aperture is proximate to a first thread opening and opens to an edge of the frame at a first point, wherein the second aperture is proximate to a second thread opening and opens to the edge of the frame at a second point, wherein the first point and the second point are adjacent to each other, and wherein the first point and the second point are between the first thread opening and the second thread opening.

26. The lacrosse head of claim 22, wherein the at least one aperture comprises a first aperture and a second aperture, wherein the first aperture is proximate to a first thread opening and opens to an edge of the frame at a first point, wherein the second aperture is proximate to a second thread opening and opens to the edge of the frame at a second point, wherein the first thread opening and the second thread opening are adjacent to each other, and wherein the first thread opening and the second thread opening are between the first point and the second point.

27. The lacrosse head of claim 22, wherein the at least one aperture comprises a first aperture and a second aperture, wherein the first aperture is proximate to a first thread opening and opens to an edge of the frame at a first point, wherein the second aperture is proximate to a second thread opening and opens to the edge at a second point, wherein the first thread opening is between the first point and the second point, and the second point is between the first thread opening and the second thread opening.

28. The lacrosse head of claim 22, further comprising a handle attached to the lacrosse head.

29. A lacrosse head comprising:

a frame having:

a stop member, wherein the stop member has stop member thread openings that are adapted to receive pocket threads;

sidewalls extending from the stop member, wherein the sidewalls have sidewall thread openings adapted to receive pocket threads; and a transverse wall joining the sidewalls at their end opposite to the stop member, wherein the transverse wall has transverse wall thread openings adapted to receive pocket threads; and at least one aperture proximate to one opening of the sidewall thread openings, the transverse wall thread openings, and the stop member thread openings, wherein the at least one aperture creates a moveable portion of the frame that flexes relative to a remaining portion of the frame, and wherein the one opening is disposed in at least a part of the moveable portion, and wherein the at least one aperture surrounds a majority of the perimeter of the one opening.

30. A method for dampening a lacrosse head pocket comprising:

forming a thread hole in a lacrosse head frame;

forming, in the lacrosse head frame proximate to the thread hole, an aperture that separates the lacrosse head frame into a moveable structure and a rigid frame structure, wherein the thread hole is disposed in at least a portion of the moveable structure, and wherein the moveable structure is adapted to flex relative to the rigid frame structure; and threading webbing of the lacrosse head pocket through the thread hole while utilizing the apparatus of claim 1.

31. The method of claim 30, wherein the moveable structure is adapted to flex in response to the webbing's pulling the moveable structure in a direction generally perpendicular to a face of the thread hole.

32. The method of claim 30, wherein forming the aperture comprises forming an aperture that surrounds a majority of the perimeter of the thread hole.

33. The method of claim 30, wherein the aperture opens to an edge of the lacrosse head frame.

34. The method of claim 30, further comprising weakening the lacrosse head frame in an area between the moveable structure and the rigid frame structure.

35. The method of claim 34, wherein weakening comprises one of perforating and scoring.

* * * * *